US005516116A

United States Patent [19]

Castro

[11] Patent Number: 5,516,116

[45] Date of Patent: May 14, 1996

[54] TETHERED BALL PRACTICE DEVICE

[76] Inventor: Paul R. Castro, 1102 E. Purdue, Lubbock, Tex. 79403

[21] Appl. No.: 368,102

[22] Filed: Feb. 10, 1995

[51] Int. Cl.[6] ..... A63B 67/10

[52] U.S. Cl. ..... 273/413

[58] Field of Search ..... 273/26 E, 413

[56] References Cited

U.S. PATENT DOCUMENTS

| | | | |
|---|---|---|---|
| 2,496,795 | 2/1950 | Johnson | 273/413 |
| 3,764,140 | 10/1973 | Lotfy | 273/413 |
| 3,829,093 | 8/1974 | Abrams | 273/413 |

*Primary Examiner*—William H. Grieb
*Attorney, Agent, or Firm*—David P. LeCroy

[57] ABSTRACT

A tethered ball practice device comprising a base member supported by a horizontal surface; a vertical support member supported by the base member; a retaining member connected to and supported by the vertical support member, wherein the retaining member includes structure for allowing orbital rotation of a ball about the vertical support member; and a tether assembly connected to and supported by the retaining member wherein the tether assembly comprises a tether cord having first and second ends, the first end connected to the retaining member, and structure for connecting the second end to the ball.

3 Claims, 1 Drawing Sheet

TETHERED BALL PRACTICE DEVICE

BACKGROUND OF THE INVENTION

1. Field of Invention

This invention relates generally to practice devices for practicing sporting skills. More specifically, it is directed to a tethered-ball practice device for use in developing batting skills.

2. Related Art

Various sports require a player to hit or strike a moving ball. In order to achieve effective hitting of the ball, good hand-and-eye coordination is required for the proper contact with the ball. This coordination is typically improved with practice.

Practice often involves the use of a pitcher for baseball or partner for tennis, or a throwing machine for throwing balls to the hitter, neither of which may be available at any given time. In addition, throwing machines are costly to purchase or lease. Both of the above means of practice require the balls hit to be recovered, and both have barriers in the speed, path and rotation of the ball that may be difficult to surmount initially.

Another means of improving ball hitting skills has been achieved through the use of a static tee. Such tees are a substantially cylindrical post with a lower end driven into the ground or kept upright by means of a base stand, and an upper end that is cupped to support the ball. As with throwing machines, this method of practice requires either a large supply of balls, or periodic retrieval of the balls in order for practice to continue.

A review of the prior art reveals that tethered-ball practice devices have long been improved upon. These practice devices generally have been comprised of a ball attached to a support arm by means of a cord, and typically positioned on a stand.

An early example of such a tethered-ball practice device is that shown in U.S. Pat. No. 3,637,209 to Earle J. Raut. This device consists of a ball attached to a handle by means of a metal cable and cord. The ball, cable and cord are swingable around an operator to give orbital motion to the ball, allowing the ball to be hit by another individual. The fact that this device requires two individuals presents a limitation in the use of the device should the second person be unavailable.

Other prior efforts to develop batting skills are found in U.S. Pat. Nos. 5,000,450 by John L. Beintema, 5,246,226 by Danny L. McGuinn, and 5,282,615 by Bill D. Green et al. Beintema discloses an elongated arm attachable to a pole which suspends a ball from the arm in tether type fashion. The arm is mountable to the pole by a single person by means of a cantilever type mechanism.

McGuinn's invention is a batting tee in which a ball is suspended from an arm. The arm is connected to a stand supported upright upon a base, and is adjustable relative to the stand. A batting instructor works with the batter to adjust the arm so that the ball hangs in the strike zone, and also aids in limiting the motion of the stand.

Green's patent, like McGuinn's, discloses a ball suspended from a tether-assembly retaining member supported by a stand and base member. However, unlike McGuinn, the height of the ball is changed by adjusting the length of the cord from which the ball is suspended. All three above batting devices function much like a static tee in that the ball hangs for striking stationary from the arm. Such devices would be limited to those players least experienced and developed in their batting skills.

Relevant prior art is also found in U.S. Pat. No. 5,098,094 by Shigeru Kita. This practice apparatus consists of a ball suspended on an elastic expanding member attached to an adjustable frame for adjusting the height of the ball.

Though the above mentioned prior arts have individual qualities and characteristics, they can be improved upon to provide a tethered ball practice device that is mobile, portable and easy to operate by a single adolescent, and allows for a quick changeup in batting stance. Adolescents that have practiced with a static tee quickly grow in skills beyond those allowable by such tee. The marketing success of a batting practice apparatus requires that the device is simple to use yet still challenges and develops the skills of the hitter. Continued practice should result in continued maturity of batting skills. When a batter grows beyond the skill level allowed by a practice device, the device loses its appeal. The devices referred to by the prior art do not perform in a manner with respect to skill level that would continue to challenge someone more skilled than a novice; therefore, the devices tend to be less marketable.

SUMMARY OF THE INVENTION

To achieve such improvements, my invention comprises a new and improved tethered ball practice device which includes a vertical support member, a rotational retaining member connected to and supported by the vertical support member, and a tether assembly connected to and supported by the retaining member. The tether assembly comprises a tether cord and ball attached to the tether cord.

The retaining member employs a means of connecting to the tether assembly. Preferably, the retaining member is adjustable upwardly and downwardly along the vertical support member, allowing for an adjustment in height according to the height and strike zone of the hitter. The retaining member is such that it is rotational about the vertical support member, allowing an orbital motion of the tether assembly. Such rotation may be provided by but not limited to means such as collars with or without bearings, collars with nylon bushings, and pillow blocks.

The vertical support member is comprised of various materials, including steel and plastic. Preferably, the vertical support member is such that it may be separated for easy portability. Various means might be utilized for connecting the segregated components of the vertical support member, such as coupling links. Preferably, the connection should be such that the vertical support member will not separate while in use. The vertical support member should be such that it may be attached to a permanent base support member, or such that it may be placed in the ground so that it of itself stands vertically from the ground.

The above description sets forth rather broadly the more important features of the present invention in order that the detailed description thereof that follows may be better understood. Accordingly, the objectives of this invention are to provide, inter alia, 1. A new and improved tethered ball hitting practice apparatus which may be easily and efficiently manufactured and marketed,
2. A new and improved tethered ball hitting practice apparatus which may be easily utilized by a single individual, 3. A new and improved tethered ball hitting practice apparatus which provides a greater hitting challenge than a conventional hiring tee, thereby improving the hitter's skills, and 4. A new and improved tethered ball hitting practice apparatus which allows changeup of a batter or use of both forehand and backhand of a hitter.

These and other objects and advantages will become more apparent to those skilled in the art by reference to the detailed description of the invention, drawings, and attendant claims.

BRIEF DESCRIPTION OF THE DRAWING

The manner in which these objectives and other desirable characteristics can be obtained is explained in the following description and attached drawings in which.

DETAILED DESCRIPTION OF THE INVENTION

With reference to the drawings, a new and improved tethered ball practice device embodying the principles and concepts of the present invention will be described. The tethered ball practice device can be used by either left-handed or right-handed batters. In addition, the practice device can be used for practicing tennis swings, both forehand and backhand.

Figure 1:
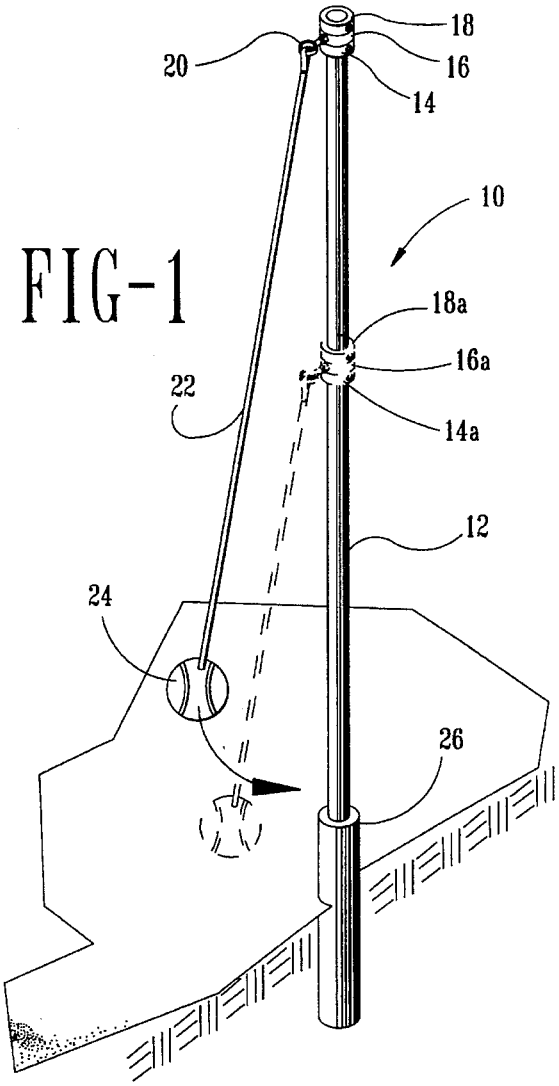
FIG. 1 is a perspective view illustrating a preferred embodiment of the tethered ball practice device and the adjustability in height of the retaining member in a fixed base support member in accordance with the present invention.
Figure 3:
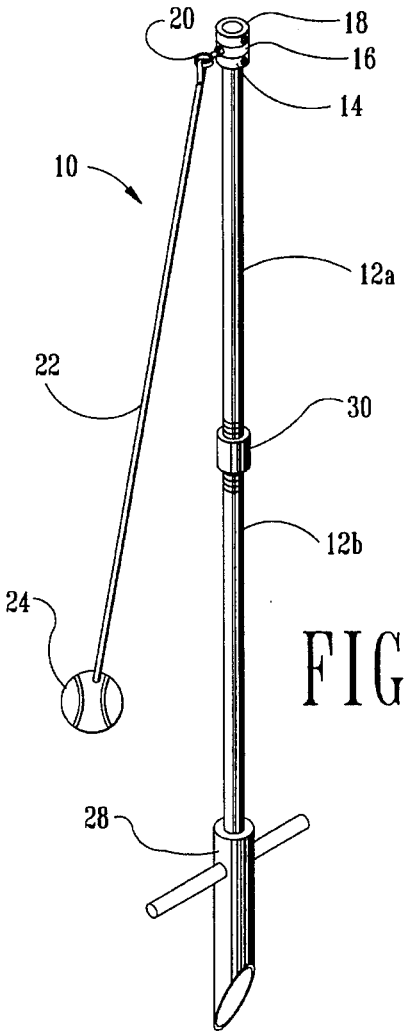
FIG. 3 is a perspective view illustrating a preferred embodiment of the portable tethered ball practice device in accordance with the present invention.

Referring now to FIGS. 1 and 3, there is shown an embodiment of the tethered ball practice device generally designated by reference numeral 10. In its preferred form, the tethered ball practice device 10 includes a vertical support member 12, a retaining member comprised of three collars 14, 16, and 18 and an eye screw 20, and a tether assembly comprised of a tether cord 22 and ball 24.

The tether cord 22 can be made of any suitable material, such as weather-resistant nylon cord. The ball 24 can be attached to the cord by any of various means, such as a bolt secured by drilling a hole through the ball 24. The opposite end of the tether cord 22 can be attached to the retaining member by means of an eye screw 20 or any other of various means.

The retaining member includes a means for allowing the collars 14, 16, and 18 to be moved along and attached securely to the vertical support member 12. In doing so, the height of the orbital path of the ball 24 can be adjusted to accommodate the strike zone of the hitter.

Various types of collars 14, 16, and 18, such as those with nylon bushings, bearings, etc., can be used depending upon the rotational speed of the ball 24 desired. Friction from the collars 14, 16, and 18 will determined the speed of rotation. The amount of friction will vary depending upon the type of collar 14, 16, and 18 used. Additionally, a pillow box might be used in place of the collar 14, 16, and 18. However, this has the limitation in that it can only be placed on the end of the vertical support member 12 and not varied according to height.

Figure 4:
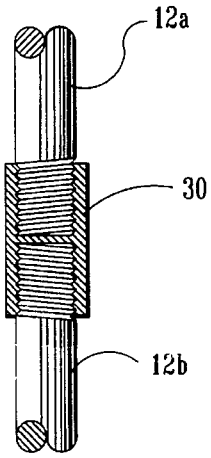
FIG. 4 is a cross-sectional view of a means of connecting two sections of the vertical support member as shown in FIG. 3.

The vertical support member 12 may be comprised of one or more sections. FIG. 4 is illustrative of a means of connecting various sections 12*a* and 12*b* of the vertical support member 12 by means of a coupling 30 or any of other various means. By allowing for two or more sections 12*a* and 12*b* of the vertical support member 12 as opposed to one solid section, greater portability of the tethered ball device 10 is allowed.

Figure 2:
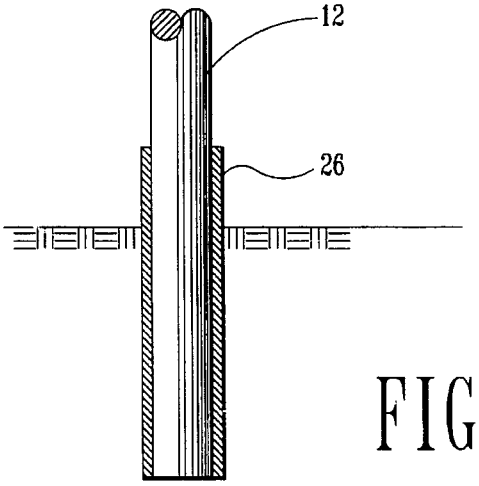
FIG. 2 is a cross-sectional view of a fixed base support member as shown in FIG. 1 with a section of the vertical support member therein in accordance with the present invention.

As illustrated in FIGS. 2 and 3, the tethered ball device 10 comprises a means for securing the vertical support member 12 nearly vertical from a horizontal surface. Such can be done by any of various means including but not limited to a tubular base member 26 secured into the ground by means including concrete, or a portable base member 28 able to be secured to the vertical support members 12*a*, 12*b* and 30 and driven into the ground. For a portable tethered ball device 10, a portable base member 28 should be provided so as to allow a means for anchoring the vertical support member 12 into the ground.

A tethered ball device 10 of the type described above is used in the following manner. The hitter fastens together the sections of the vertical support member 12 if more than one section and places the tethered ball device 10 nearly vertically upright from a horizontal surface, either by means of a base member 26 or 28 or by placing the vertical support member directly in the ground. The hitter then throws or hits the ball 24 in a clockwise or counterclockwise rotation. Depending upon the direction of rotation, the hitter can practice batting left or right-handed, or forehand or backhand swings. Such batting practice provided by an orbital motion of the ball 24 as opposed to a stationary tee is believed to provide superior training results for a young hitter.

While there has been disclosed effective and efficient embodiments of the invention using specific terms, it should be well understood that the invention is not limited to such embodiments as there might be changes made in the arrangement, disposition, and form of the parts without departing from the principle of the present invention as comprehended within the scope of the accompanying claims.

What is claimed is:

1. A tethered ball practice device comprising, in combination:

(a) a base member supported by a horizontal surface;

(b) a vertical support member supported by said base member;

(c) a retaining member connected to and supported by said vertical support member, wherein said retaining member includes means for allowing orbital rotation of a ball about said vertical support member, said retaining member remaining at a fixed position along said vertical support member during the orbital rotation of said ball, wherein said retaining member comprises one or more collars movable along said vertical member and includes means for remaining fixed at one location on said vertical support member during orbital rotation of said ball; and (d) a tether assembly connected to and supported by said retaining member wherein said tether assembly comprises a tether cord having first and second ends, said first end connected to said retaining member, and means for connecting said second end to said ball.

2. A device in accordance with claim 1 wherein said vertical support member comprises a means for separating said vertical support member into two or more pieces serving to provide greater portability of said device.

3. A device in accordance with claim 1 wherein said retaining member includes a means for moving along said vertical member to raise or lower the height of said tether assembly.

* * * * *